US005845901A

United States Patent [19]

Coombs et al.

[11] Patent Number: 5,845,901

[45] Date of Patent: Dec. 8, 1998

[54] PARALLEL MOVING TRAY SORTER

[75] Inventors: Peter M. Coombs, Tustin, Calif.; Klaus Thogersen, Klampenborg, Denmark

[73] Assignee: Gradco (Japan) Ltd., Tokyo, Japan

[21] Appl. No.: 555,651

[22] Filed: Nov. 13, 1995

[51] Int. Cl.[6] ..... B65H 39/10

[52] U.S. Cl. ..... 271/293; 271/294; 270/58.15; 270/58.19

[58] Field of Search ..... 271/293, 294, 271/292; 270/58.15, 58.19

[56] References Cited

U.S. PATENT DOCUMENTS

| | | | |
|---|---|---|---|
| 4,466,609 | 8/1984 | Lawrence | 271/293 |
| 4,911,424 | 3/1990 | Lawrence | 271/293 |
| 4,941,657 | 7/1990 | Kitajima et al. | 271/294 X |
| 5,255,902 | 10/1993 | Coombs . | |
| 5,351,947 | 10/1994 | Aaron | 271/293 |
| 5,524,873 | 6/1996 | Hosoi et al. | 271/293 X |
| 5,535,012 | 7/1996 | Matsumoto et al. | 271/293 X |
| 5,593,153 | 1/1997 | Coombs | 271/293 X |

FOREIGN PATENT DOCUMENTS

| | | | |
|---|---|---|---|
| 2253617 | 9/1992 | United Kingdom | 271/293 |

*Primary Examiner*—David H. Bollinger
*Attorney, Agent, or Firm*—Newton H. Lee, Jr.

[57] ABSTRACT

A moving bin sorter of the type in which the trays are individually and collectively moved vertically relative to a sheet inlet location and opened to provide an enlarged sheet entry space for receiving the sheets, has cams and counter-balancing springs to lift the trays supported in a support structure which maintains the trays in parallel relation, thereby maintaining equal spacing for printed sheet storage along the complete effective length of the trays. In one form, the support structure is a unit moved upwardly by the springs, and in another form, the support structure has a member integrated with the tray housing and a cooperative member moved upwardly by the springs, the trays being supported at all times in parallel relation.

12 Claims, 6 Drawing Sheets

PARALLEL MOVING TRAY SORTER

BACKGROUND OF THE INVENTION

The present invention relates to sorters or sheet receivers adapted to receive printed sheets from copiers, printers, or facsimile machines in an array of sheet receiving trays which are vertically spaced, extend generally horizontally and individually moved vertically relative to a sheet infeed location by cams which provide an increased space between trays at which the sheets are carried from the sheet producing machine into the trays, wherein the trays are relatively close together at other times, and an upward bias is applied to the trays to move them into engagement with the cams.

PRIOR ART

The prior art is exemplified by the sheet sorting machines shown in U.S. Pat. No. 4,911,424 granted Mar. 27, 1990 to Lawrence, wherein the set of sheet receiving trays are shifted vertically at their sheet inlet ends by rotary cam mechanisms which engage with trunnions on the opposite sides of the trays and wherein a bottom tray support extends to a position below the outer ends of the trays so that the entire set of trays is caused to move upwardly and downwardly in unison responsive to operation of the cams to increase the space at the inlet ends of the trays into which sheets can be fed from the processing unit. The trays below the cams are biased upward by lifts on the bottom tray or tray support engaged by the top tray above the cams. The trays below the cams present a tray angle which is the same for all trays for receiving sheets.

In the prior Coombs U.S. Pat. No. 5,255,902 granted Oct. 26, 1993, a variation of the prior Lawrence sorting machine is illustrated, wherein the apparatus includes means for automatically stapling the sheets in the respective trays, and, further, the bottom tray support is counterbalanced by an upward bias supplied by a tension spring, thereby reducing the load of the trays and the paper sheets thereon which is applied to the top of the tray shifting cams as compared with the above referenced Lawrence patent.

In addition, as shown in Aaron U.S. Pat. No. 5,351,947 granted Oct. 4, 1994 a sorter has high and low pitch cams which are rotated to move a set of trays vertically past a sheet inlet, and at one end of the trays, in the form shown, at the inlet end of the trays, the trays are supported in a vertical slot so that the tray is restrained against rocking about the followers which engage the cams for shifting the trays vertically, so that theoretically the trays at all times travel in a substantially parallel relationship, whereas the prior sorting devices of the previous mentioned Lawrence and Coombs patents move the trays in parallel relation only during the transition from positions above and below the tray opening cams, but at the outer ends of the trays, the trays pivot relative to one another so as to effectively form an enlarged convergent space into which the sheets are supplied from the sheet inlet.

In a modification of the structure of the Aaron patent, referred to above, the outer ends of the trays, downstream of the sheet feed direction, are guided in vertical slots to prevent tilting of the trays about the trunnions which are driven by the high and low pitch cams, upstream of the sheet infeed direction, so that the trays are moved in parallel relation, but the outer ends of the trays and the paper therein are not specifically mechanically guided in parallel relation at their opposite ends.

SUMMARY OF THE INVENTION

The present invention involves a unique combination of means for moving the trays of a moving bin sorter wherein the trays are arranged in vertically spaced, horizontally extended relation and are moveable between closely spaced positions above and below a sheet infeed location and a position at which an enlarged space is provided between the trays at the sheet infeed location, and the trays are at all times during and after their movements, more effectively supported in parallel relation at both ends.

The combination of means referred to above involves three factors, namely, 1) tray shifting cam and trunnion means for vertically moving the trays to positions above and below the sheet infeed location, 2) means including a counterbalance spring for applying an upward bias to the trays between their ends, and 3) tray supporting and guiding means for the trays extending upwardly and guiding the inner and outer ends of the trays for vertical movement in parallel relation as the inner ends of the trays are moved vertically to form an enlarged sheet entry space.

Such a sorter construction has improved operational and geometrical advantages enabling receipt of a comparatively large number of sheets between the trays, versus the prior sorters. In addition, the coaction of the means referred to above facilitates or is facilitated by utilization of trays which are also comparatively short in their horizontal extension, so that the sorter overall has a small footprint, as disclosed in the U.S. application of Coombs, filed Oct. 23, 1995 Ser. No. 546,848, now U.S. Pat. No. 4,493,153 (case 109A), co-owned herewith and to which reference may be made.

More specifically, in the present invention, the bottom tray support structure is in the form of frame members having vertical slots in which the inner and outer ends of the trays are vertically moved in parallel relation by the cam means to provide the enlarged sheet entry space but in which the trays are locked against tilting movement when the trays are in their closely spaced parallel positions above and below the cam means responsive to engagement of trays next above and next below the cams.

In one form of the invention, the frame members are interconnected at their lower ends by a lower tray support which is caused to move upwardly in response to the tension or bias applied by springs connected to the bottom tray support and adapted to counterbalance the weight of the trays and the paper in the trays located below the tray shifting cams, so as to bias such trays upwardly for engagement with the bottom of the cams, while the weight of the trays and the paper therein above the cams move such trays downwardly for engagement with the top of the cams, but, at all times, the trays are locked against tilting movement about the cam followers or trunnions as the trays are moved in vertical directions and in parallelism in the slots.

In another form of the invention, vertical slots are provided for guiding the cam followers or trunnions into engagement with the top and bottom of the cams but the companion vertical slots in which the outer ends of the trays move upwardly and downwardly are formed in a stationary portion of the sorter housing or mainframe and the tension springs which counterbalance the weight of the trays below the cams are connected to a cross bar to the lowermost tray or side plate therefor.

The invention has other features and advantages which will become apparent to those skilled in the art from the following detailed description taken together with the accompanying drawings forming a part hereof.

DESCRIPTION OF THE PREFERRED EMBODIMENT

Figure 1:
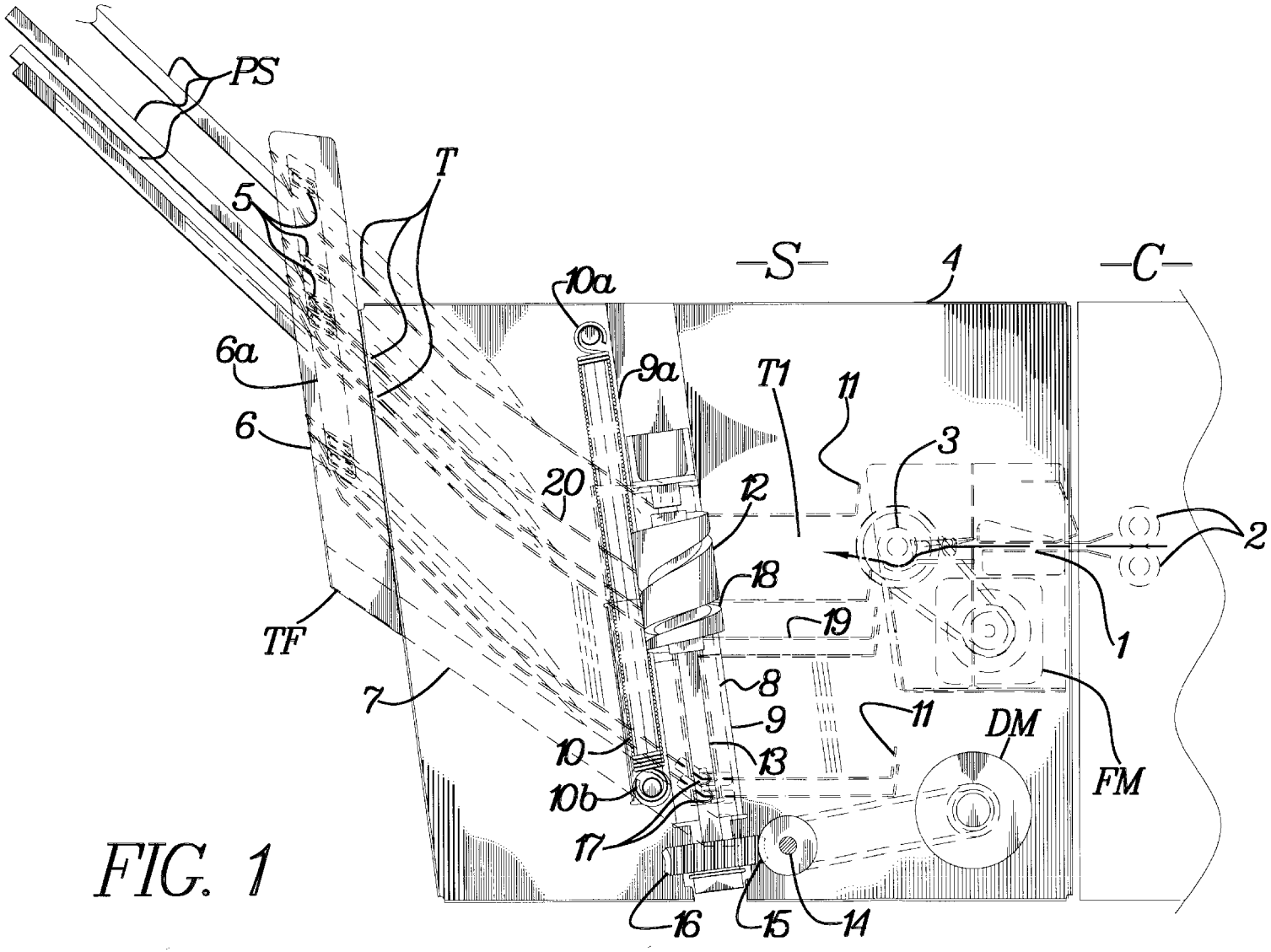
FIG. 1 is a side elevational view showing a moving bin sorter incorporating the invention according to one embodiment.
Figure 5A:
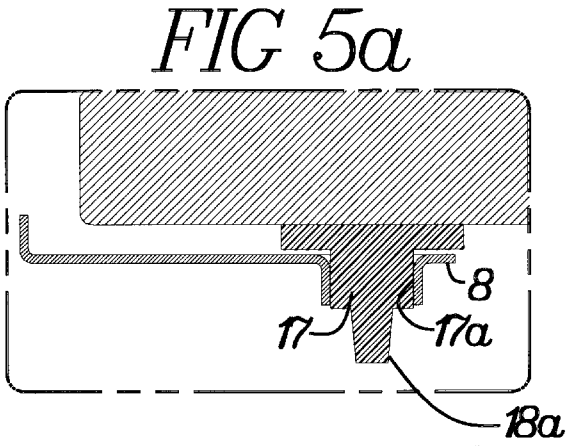
FIG. 5*a* is a section on the line 5*a*—5*a;*
Figure 5:
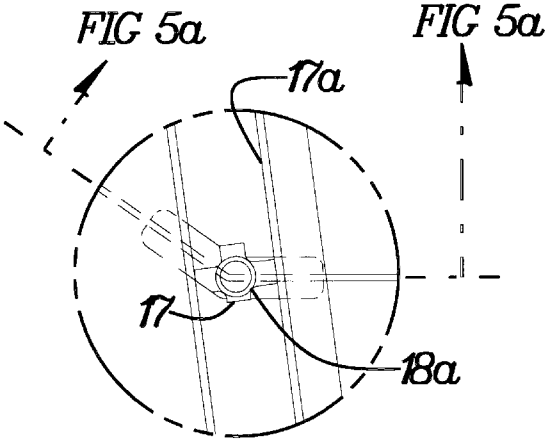
FIG. 5 is a fragmentary vertical elevation on the line 5—5 of FIG. 3 showing the geometry of tray side plate, trunnion and tray.

As seen in the drawings, referring first to FIGS. 1 through 6, a sheet receiving or sorting machine S is associated with a copier or printer C and is adapted to receive sheets from a copier or printer through a sheet path 1 from the output rolls 2 of the host machine. Infeed roll 3 is driven by suitable feed motor FM enclosed within the sorter housing 4.

Figure 2:
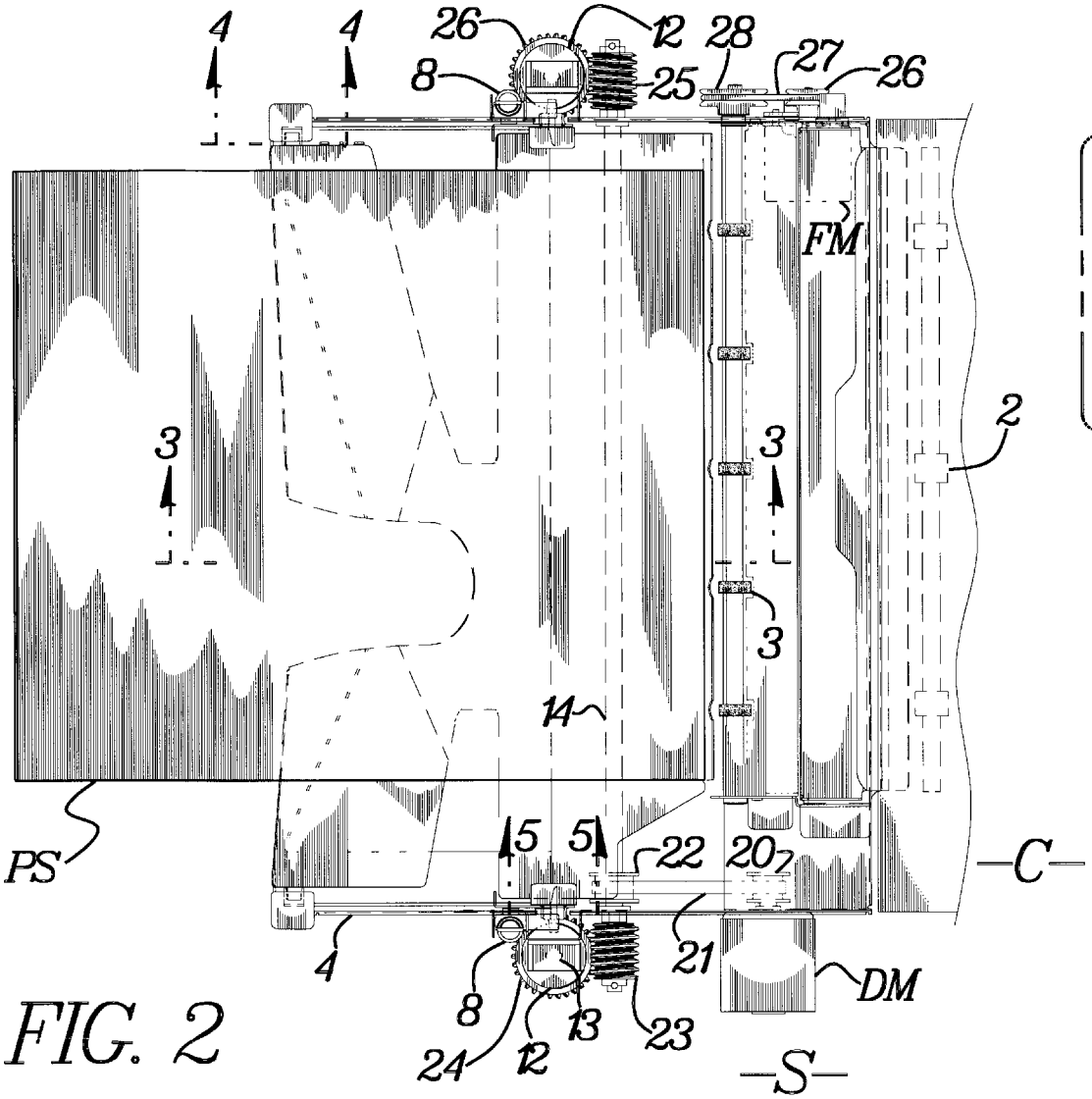
FIG. 2 is a top plan view.

Also, in this form of the invention, within the sorter housing or main frame 4 is a tray support structure or tray frame TF in which a set of sorter trays T are mounted, the trays extending horizontally and upwardly from the infeed 3 to receive printed sheets PS fed into the trays from the host machine C. The trays T, to be described more specifically hereinafter, have outer ends 5 supported for vertical sliding movement in a pair of upwardly extended outer tray end support or guide members 6 disposed at opposite sides of the trays. As seen in FIGS. 1 and 2, the members 6 are joined with a lower tray support plate 7 and extend upwardly at opposite sides of the trays for vertical movement relative to the sorter main frame or body structure 4.

At the lower end of the tray support 7, at opposite sides of the trays within the housing 4, is a pair of tray frame members or side plates 8 vertically shiftably mounted in opposing vertical slots or channels 9 in housing 4 and extending upwardly in substantial parallel relation with the outer tray end support members 6. A side wall 9*a* of the slots or channels provides a sliding bearing surface for side plates 8, which may be, if desired, provided with suitable anti-friction bearings.

A pair of coiled tension springs 10 are interconnected at their upper ends 10*a* with the side walls of the housing 4, and at their lower ends 10*b* with the bottom tray support 7 or side plates 8, whereby to apply an upward bias to the support frame TF and the trays supported therein.

Means are provided for mechanically shifting the trays T upwardly and downwardly so a to provide a large entry space T1 for receipt of sheets entering the sorter from the infeed 3 and for moving the trays between positions closely spaced together above and below the enlarged sheet entry space T1 and resting on or supported one on the other at their sheet inlet ends and their outer ends. As here shown, the tray shifting means comprise a pair of rotary spiral cams 12 mounted upon drive shafts 13 and adapted to be rotated in opposite direction by a drive motor DM through a cross shaft 14, worms 15 and worm gears 16 on the respective shafts 13.

Cam followers 17 including trunnions engageable in a spiral cam track 18 in the respective cams 12 and mounted at opposite sides of the trays at the junction between the inner horizontal tray sections 19 and the upwardly inclined sections 20, are adapted to cause upward and downward movement of the inner ends of the trays responsive to rotational movement of cams 12 in opposite directions.

Downward engagement of the cam followers 17 with the top of the cams and in cam track 18, in one direction of rotation, is caused by the weight of the trays, plus any paper sheets in the trays resting one on the other above the cams. On the other hand, upward engagement of the trunnions 17 by the cam track 18, upon rotation of the cams in the other direction, is in response to the upward bias of the springs 10 which urge the trays upwardly by virtue of connection of the springs to frame structure TF, in an upward direction into engagement with the lower ends of cams 12.

In the form of the trays shown herein, the trays are configured like those disclosed in the pending application of Coombs (case 109A) referred to above, so as to have an extension in the horizontal direction which is quite short, as compared with typical trays, as shown in the prior art cited at the commencement hereof. In this connection it will be seen that each tray has at its inner end, an inner end section 19 extending a substantial distance horizontally, and an upwardly inclined section 20 which extends horizontally to the outer ends of the trays for connection with the support or frame members 6 at opposite sides of the apparatus.

Figure 3:
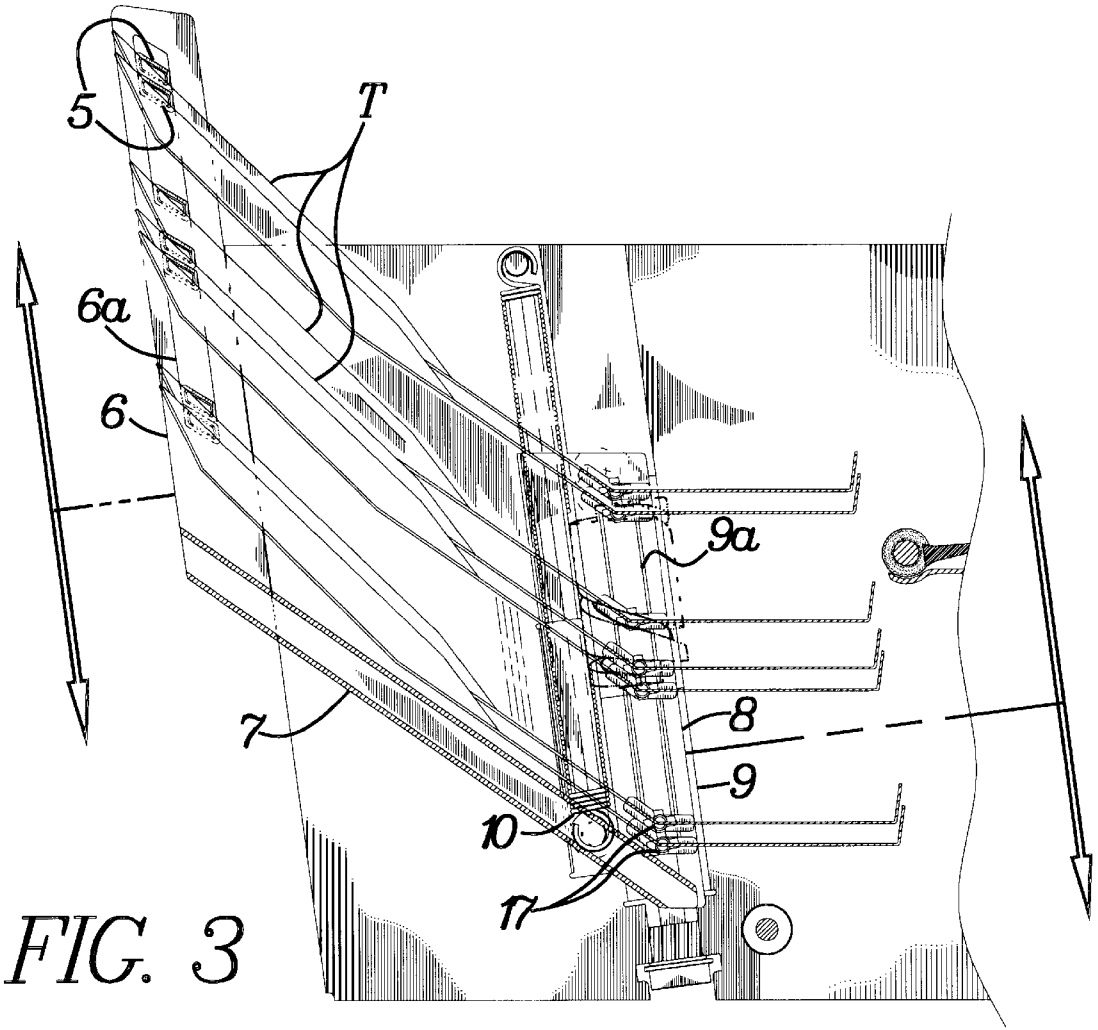
FIG. 3 is a fragmentary vertical section on the line 3—3 of FIG. 2 showing the operation of the sorter.

In accordance with the form of the present invention now being described, the trays T are moved vertically relative to one another in the slot 6*a* and slot or channel 9 of tray frame members 6 and 4 to form the enlarged sheet entry space T1. However, during all other movements of the trays, the trays move together and are retained in their substantial parallel relation by the interaction between the cams 12, the outer tray ends 5 with tray support member 6 and the trunnions 17 with the frame or tray side plate members 8, as the trays above the cams 12 move upwardly, upon engagement of successive trays with the trays thereabove, while the coiled springs 10 move the tray frame structure upwardly to maintain the uppermost tray located below the cams in engagement with the bottom of the cams, and as the trays above the cams move downwardly by gravity, the trays below the cams are moved downwardly against the bias of the springs, as successive trays are moved downwardly by the cams, as seen in FIG. 3.

Figure 4A:
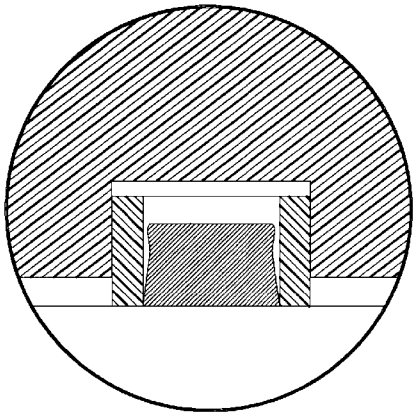
FIG. 4*a* is a section through the tray, tray end and liner.
Figure 4:
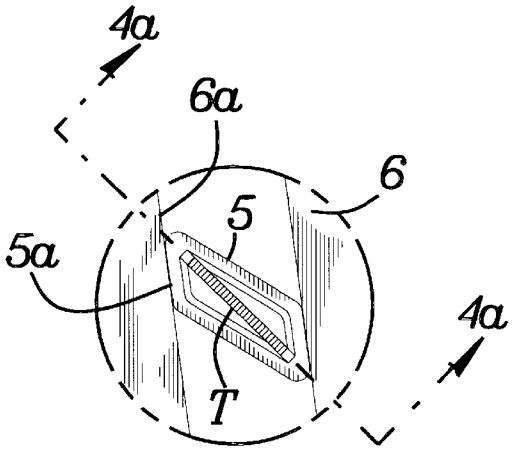
FIG. 4 is a fragmentary vertical section on the line 4—4 of FIG. 2 showing the geometry of the tray, tray end and outer tray end supporting guide.

The construction of the outer tray ends 5 and the manner of their movement in the vertical slot 6*a* of the outer frame member 6 will best be understood upon reference to FIGS. 4 and 4*a*. Each tray end 5 includes a sliding member 5*a*, here shown as being in the form of a trapezoidal block vertically and slidably disposed in the slot 6*a* of the outer end frame member 6 with a connecting portion of the tray T extending into and connected to the block 5*a*. As a result of this construction, the tray end 5 is able to vertically slide in either direction within the slot 6*a* to enable the trays to be separated by the cams 12 to form the enlarged space T1, but the tray ends 5 will always travel in a parallel relation, and any downward tilting of the trays about the trunnions 17 is prohibited by the locking action of the tray tips 5 in the slots 6*a*. Various other forms of slidable connections between the support members 6 and the tray ends 5 may be employed, so long as the effect is to permit vertical sliding movement for enabling the opening of the trays by the cams, but do provide the locking action of the trays which are spaced by the cams to form the enlarged sheet entry space T1.

As indicated above, the outer end support 6 also moves vertically in the embodiment now being described as a result of the bottom support 7 being connected to the tray side plates 8 which are vertically movable in the slot or channel 9 in the housing construction in parallel relation to the slot 6*a*. Trunnion members 17 which are located below the cams 12 are biased upwardly towards the cams, as shown, by the coil springs 10 acting upwardly on the bottom frame member 7, and the trunnion members 17 are also free to relatively shift vertically in a vertical slot 17*a* in the tray side plate 8 as the trunnion portion 18*a* engages in the cam profile 18 so as to cause the trays to shift relatively vertically and form the enlarged sheet receiving space T1.

Figure 6:
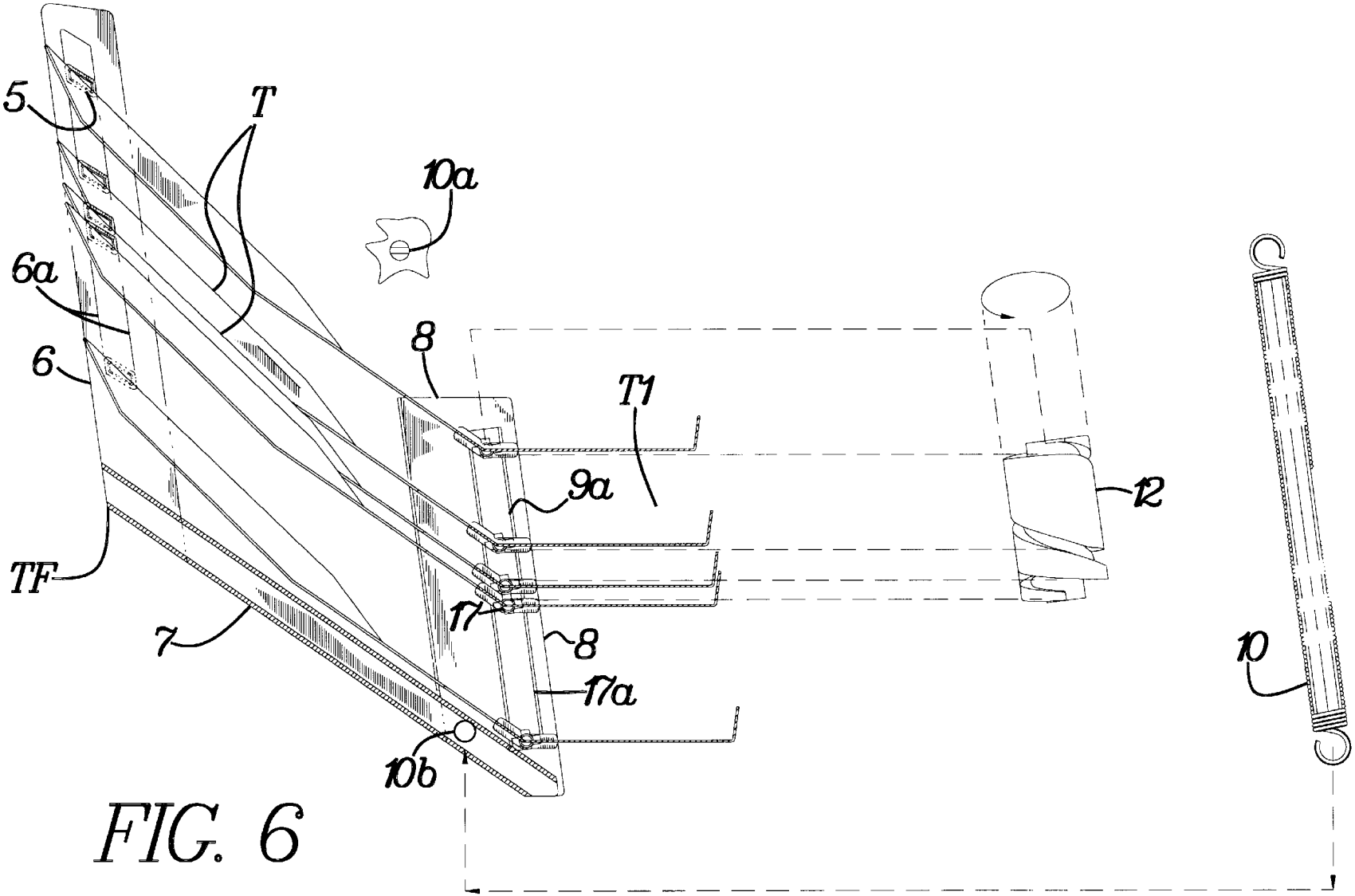
FIG. 6 is an exploded detail view illustrating the tray support frame arrangement and the means for shifting the tray and the support frame.

The details of the tray frame structure TF are readily recognized upon reference to the exploded detail view of FIG. 6. It will be recognized that the frame structure TF when connected with the spring 10 at fixed points 10*a* and 10*b* of the frame TF is normally biased upwardly and that the trays T are freely vertically shiftable relative to the side plates 8 in slots 17*a*, while the side plates 8 are vertically shiftable in slots 9, and the outer tray ends 5 in slots 6 a of supports 6. However, the relative vertical disposition of the trays in the side plates slots or channels 9 and the end support slots 6*a* is determined by the relative rotational position of the cams 12 so as to provide the enlarged space T1, but above and below the cams, the trunnions 17 have blocks which contact one another to determine the spacing between the trays at this point, while the tray ends 5 contact one another in the slot 6*a* to determine the spacing of the outer ends of the trays. Thus the trays at all times will remain parallel due to the formation of the tray support frame structure as a parallelogram.

Figure 7:
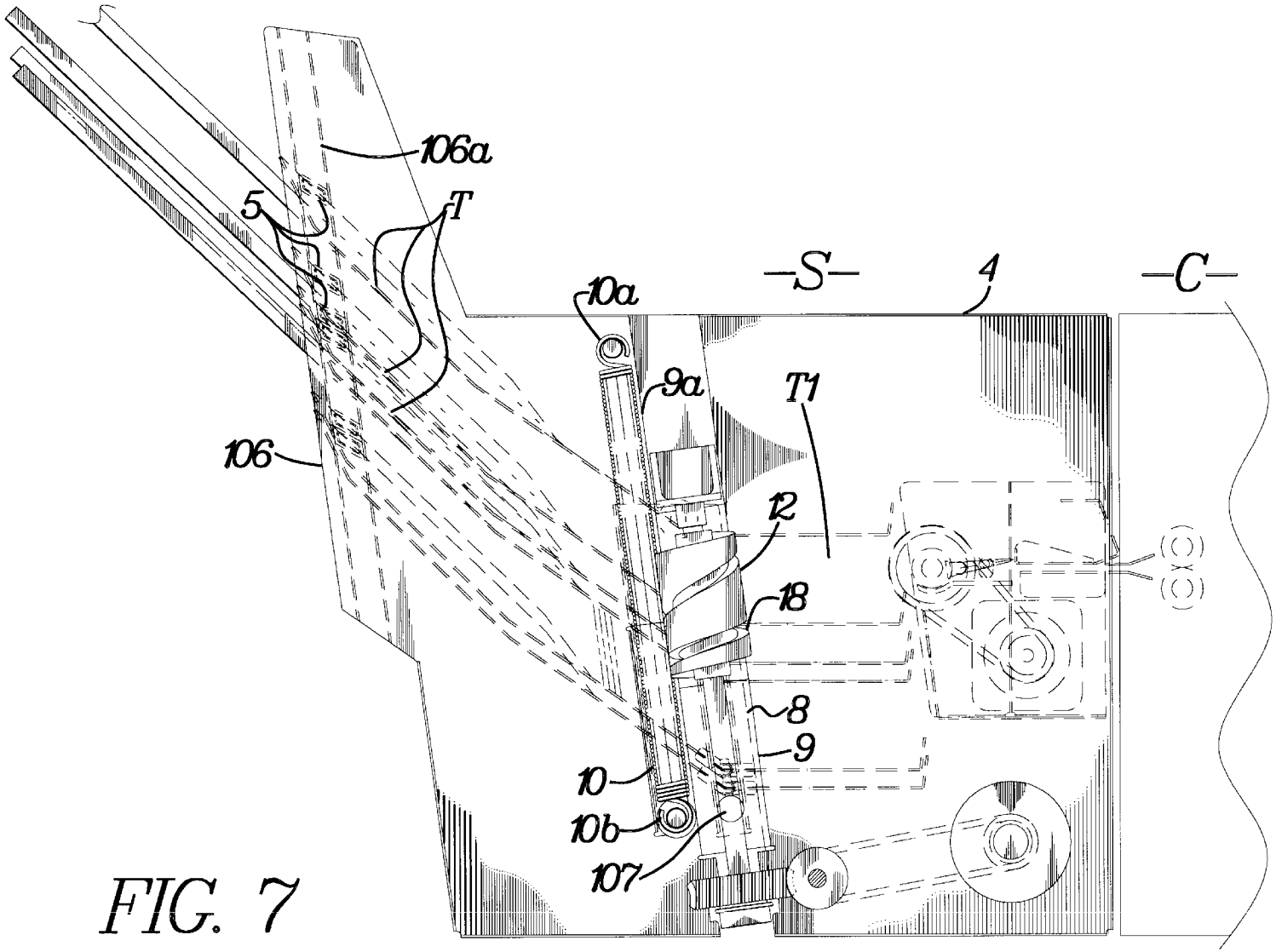
FIG. 7 is a view like FIG. 1 showing another embodiment of the invention.
Figure 8:
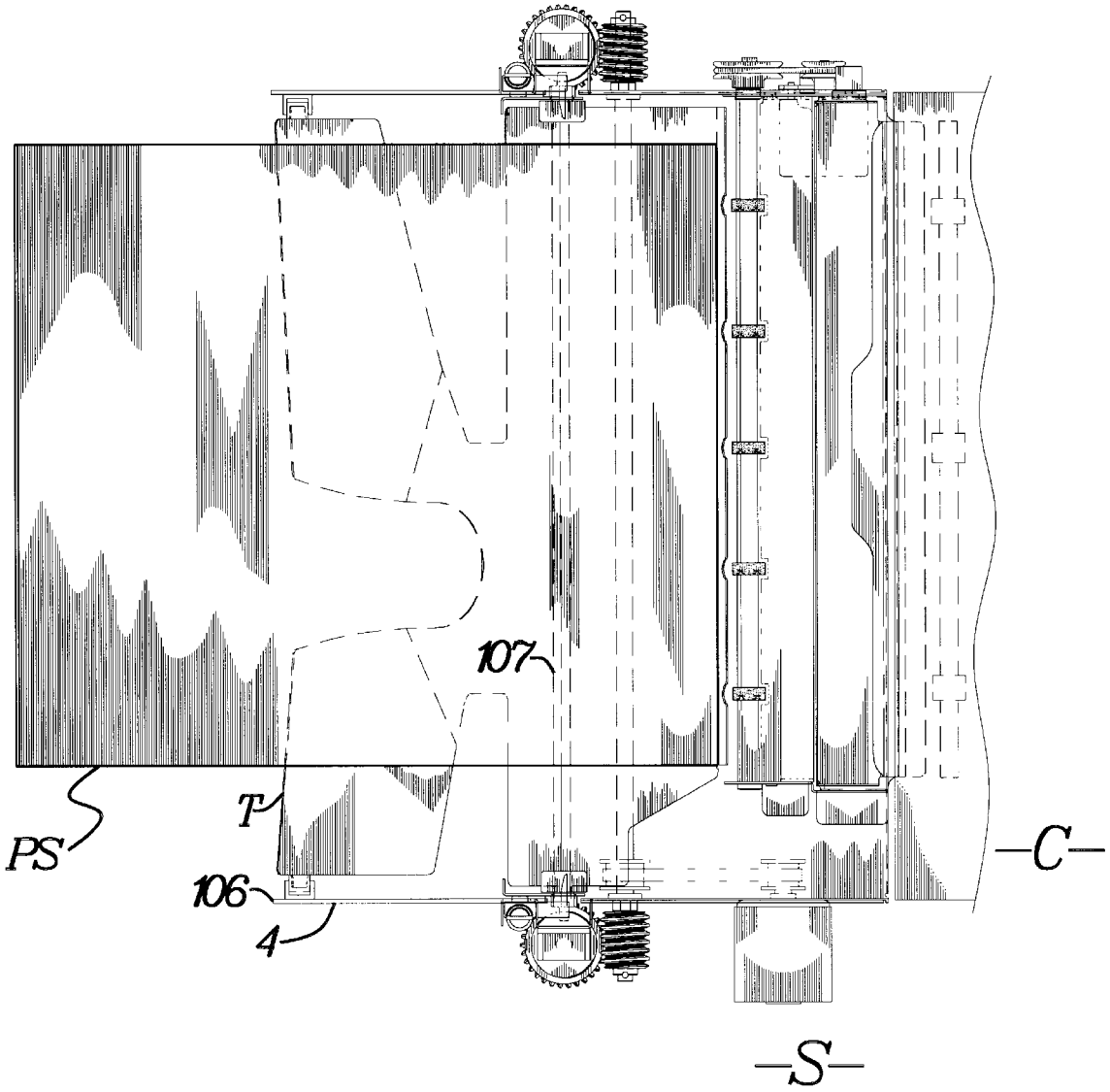
FIG. 8 is a top plan view of the sorter of FIG. 7.

Referring to FIGS. 7 and 8, there is shown a variation of the parallelogram in which the outer tray ends support is not physically connected with the tray side plates by the bottom tray support 7.

Instead, a cross rod 107 is extended beneath the lowermost tray and connected with the tray side plates 8 at opposite sides of the assembly, and, in addition, the coil springs 10 are connected to the tray side plates 8. Also, the outer tray end supports 106 having the vertical slots 106*a* for receiving the outer tray ends 5, are formed as integral parts of the opposite sides of the housing 4.

In this embodiment, the same parallel relationship is maintained between the tray side plates 8 in sliding engagement with the side edge 9*a* of the slot or channel 9 in the housing with respect to the vertical slot 106*a*, so that as the trays move upwardly and downwardly, as in the case of the first embodiment, the trays move in closely spaced parallel relation above and below cams 12, but in response to rotation of the cams in either direction, the enlarged sheet receiving space T1 is formed by the cams. However, the trays T can not tilt, but instead the tray ends 5 move upwardly in slot 106*a* and the side plates 8 move vertically in slots or channels 9, so that the parallelism is maintained.

Having thus described two embodiments of the inventions, what is sought to be covered is best defined in the appended claims.

We claim:

1. In a sheet sorting machine of the type including a housing, a set of trays which are arranged in vertically spaced, horizontally extended relation and are vertically movable between closely spaced positions supported one on the other above and below a sheet entry location forming an enlarged sheet entry space between adjacent trays, including rotary cam means for moving the trays between said positions and forming said enlarged sheet entry space when stationary, cam followers at opposite sides of said tray engageable with said cam means, the improvement comprising; first support means including a support member disposed below the lowermost tray for moving said trays upwardly to engage said cam followers with said cams, vertically movable additional support means for the inner and outer ends of the trays, said vertically movable additional support means supporting said trays for vertical movements in parallel relation in both said closely spaced positions and said enlarged sheet entry space position.

2. In a sheet sorting machine as defined in claim 1, means for applying an upward bias to the first support means and the trays below said cam means.

3. In a sheet sorting machine as defined in claim 1, said additional support means for said inner and outer ends of said trays being sliding supports including guides for the inner and outer ends of said trays forming with said trays a parallelogram.

4. In a sheet sorting machine as defined in claim 1, said additional support means for said inner and outer ends of said trays being sliding supports including guides for the inner and outer ends of said trays forming with said trays a parallelogram, said guides for the inner and outer ends of said trays being interconnected with one another and vertically movable in unison.

5. In a sheet sorting machine as defined in claim 4, including spring means for applying an upward bias to said first support means.

6. In a sheet sorting machine as defined in claim 1, said additional support means for said inner and outer ends of said trays being sliding supports including guides for the inner and outer ends of said trays forming with said trays a parallelogram, said guides for said outer ends of said trays being fixed to said housing.

7. In a sheet sorting machine as defined in claim 6, including spring means for applying an upward bias to said first support means.

8. In a sheet sorting machine as defined in claim 1, said additional support means for said inner and outer ends of said trays including sliding supports including guides for the inner and outer ends of said trays forming with said trays a parallelogram, said guides for said inner ends of said trays including vertical guide slots and tray side plates vertically shiftable in said slots and extending upwardly therein from said support member below the lowermost tray as aforesaid.

9. In a sheet sorting machine as defined in claim 8, spring means for applying an upward bias to said side plates.

10. In a sheet sorting machine as defined in claim 8, spring means for applying an upward bias to said side plates as aforesaid, said guide for said outer ends of said trays and said side plates being interconnected by said support member, below the lowermost tray for movement in unison.

11. In a sheet sorting machine as defined in claim 8, spring means for applying an upward bias to said side plates as aforesaid, said guide for said outer ends of said trays being fixed to said housing.

12. In a sheet sorting machine as defined in claim 1, said additional support means for said inner and outer ends of said trays being sliding supports including guides for the inner and outer ends of said trays forming with said trays a parallelogram, including means for locking said sliding supports against vertical movement when said cam means is stationary including outer tray ends having a locking, sliding fit with the guide for the outer ends of said tray.

* * * * *